US012317972B1

(12) United States Patent
Merideth

(10) Patent No.: US 12,317,972 B1
(45) Date of Patent: Jun. 3, 2025

(54) THERMOCHROMIC NECKLACE PENDANT

(71) Applicant: Darryl Merideth, Baton Rouge, LA (US)

(72) Inventor: Darryl Merideth, Baton Rouge, LA (US)

( * ) Notice: Subject to any disclaimer, the term of this patent is extended or adjusted under 35 U.S.C. 154(b) by 0 days.

(21) Appl. No.: 18/439,403

(22) Filed: Feb. 12, 2024

(51) Int. Cl.
*A44C 25/00* (2006.01)

(52) U.S. Cl.
CPC ..... *A44C 25/001* (2013.01)

(58) Field of Classification Search
CPC .. A44C 25/001; A44C 15/0015; A45D 42/00; A45D 42/04; A45D 42/12; A45D 42/16
USPC ..... 132/304, 316; 359/879; 224/255; D28/64.1, 64.2, 64.7
See application file for complete search history.

(56) References Cited

U.S. PATENT DOCUMENTS

D63,765 S * 1/1924 Alvarez ..... D11/83
3,025,820 A * 3/1962 Rosenthal ..... A44C 27/00 63/23
3,802,945 A * 4/1974 James ..... B44F 1/14 40/448
4,184,344 A 1/1980 Pepin
4,220,016 A 9/1980 Frenger
5,813,766 A 9/1998 Chen
6,675,744 B1 1/2004 Levan
D718,169 S 11/2014 Brinbaum
D811,262 S 2/2018 Abdoo
2008/0190138 A1* 8/2008 DiCiacco ..... G01K 11/165 374/E13.002

FOREIGN PATENT DOCUMENTS

CA 2213145 11/2000

* cited by examiner

*Primary Examiner* — Jack W Lavinder

(57) ABSTRACT

A thermochromic necklace pendant includes a pendant frame, a mirror, and thermochromic material. The pendant frame includes a transparent or translucent material. The pendant frame includes an outer border portion and a central mounting portion. The mirror is mounted on the central mounting portion and within the outer border portion. The outer border portion is hollow. The thermochromic material is positioned in the outer border portion and designed to change colors in response to temperature to create a multi-colored aesthetic effect to boost or improve the mental and emotional health and wellbeing of the wearer and others viewing the necklace pendant.

10 Claims, 6 Drawing Sheets

THERMOCHROMIC NECKLACE PENDANT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to necklaces and more particularly pertains to a new thermochromic necklace pendant for improving the mental and emotional health and wellbeing of the wearer and others viewing the necklace pendant. As is well known, rates of depression and suicide have been rising, especially since the COVID pandemic and lockdowns. It is therefore important for people to seek ways to regularly improve the mental and emotional health and wellbeing of themselves and those around them.

(2) Description of Related Art Including Information Disclosed Under 37 CFR 1.97 and 1.98

The prior art relates to necklaces. The prior art, as best understood, does not disclose a necklace pendant comprising a mirror and a border filled with thermochromic material.

BRIEF SUMMARY OF THE INVENTION

An embodiment of the disclosure meets the needs presented above in a thermochromic necklace pendant generally comprising a pendant frame, a mirror, and thermochromic material. The pendant frame includes a transparent or translucent material. The pendant frame includes an outer border portion and a central mounting portion. The mirror is mounted on the central mounting portion and within the outer border portion. The outer border portion is hollow. The thermochromic material is positioned in the outer border portion and designed to change colors in response to temperature to create a multi-colored aesthetic effect to boost or improve the mental and emotional health and wellbeing of the wearer and others viewing the necklace pendant.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
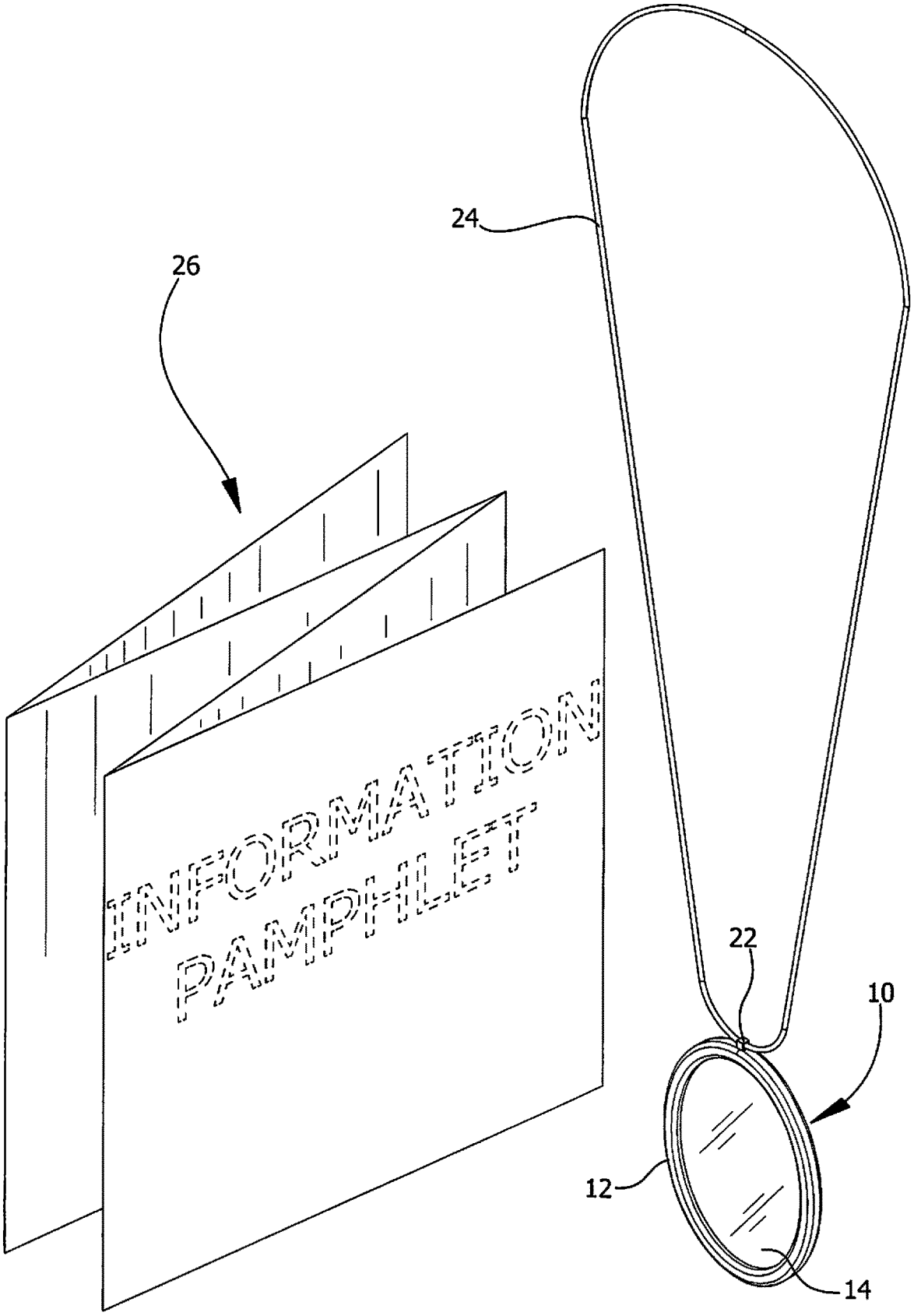
FIG. 1 is a perspective view of a thermochromic necklace pendant according to an embodiment of the disclosure.
Figure 2:
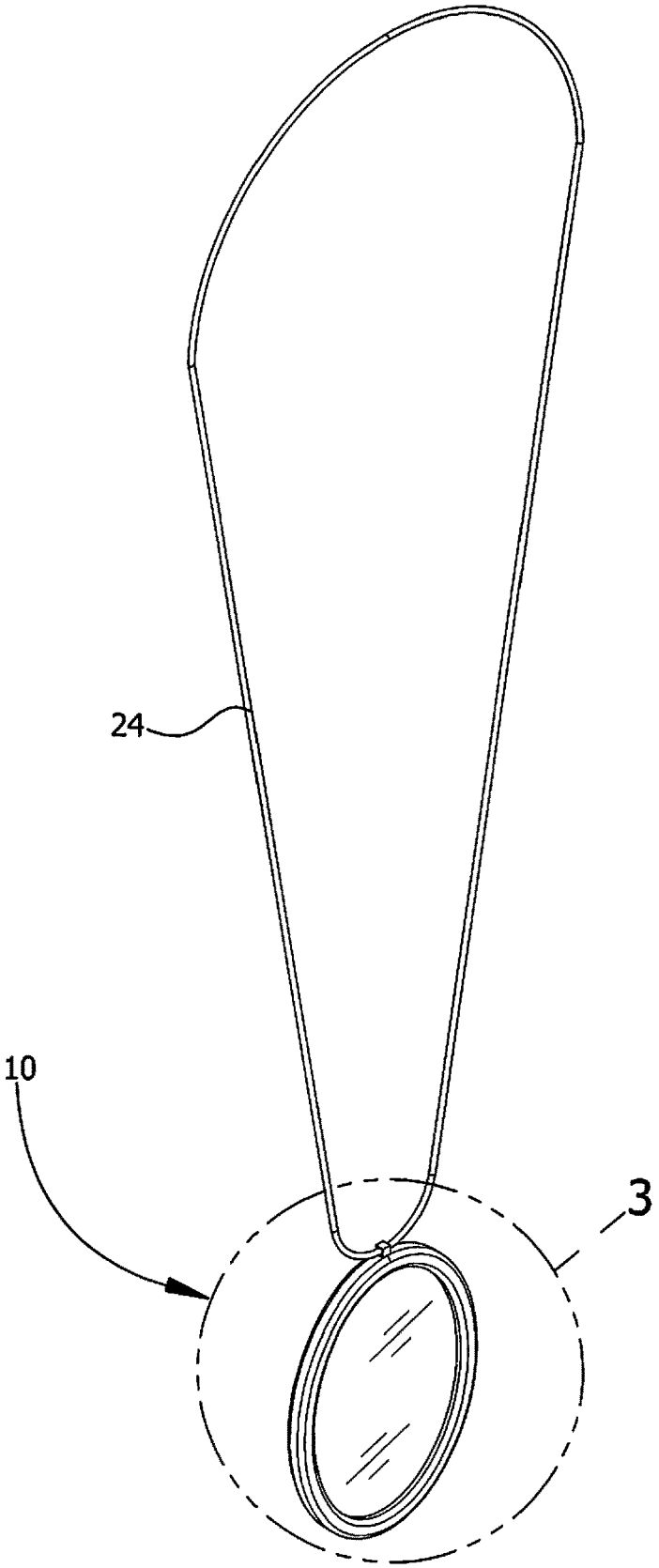
FIG. 2 is a perspective view of an embodiment of the disclosure.
Figure 3:
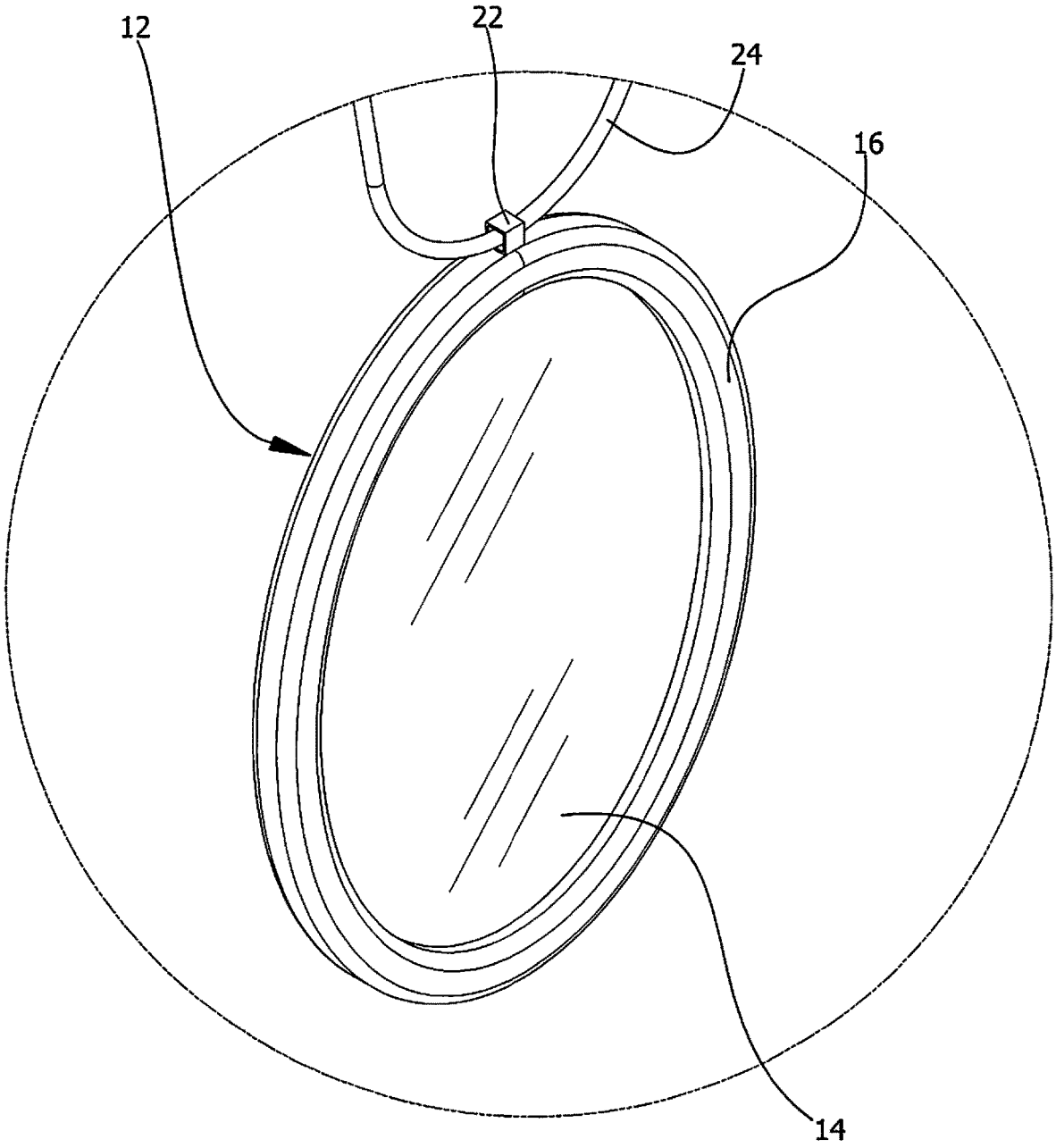
FIG. 3 is a close-up view of a portion of an embodiment of the disclosure.
Figure 4:
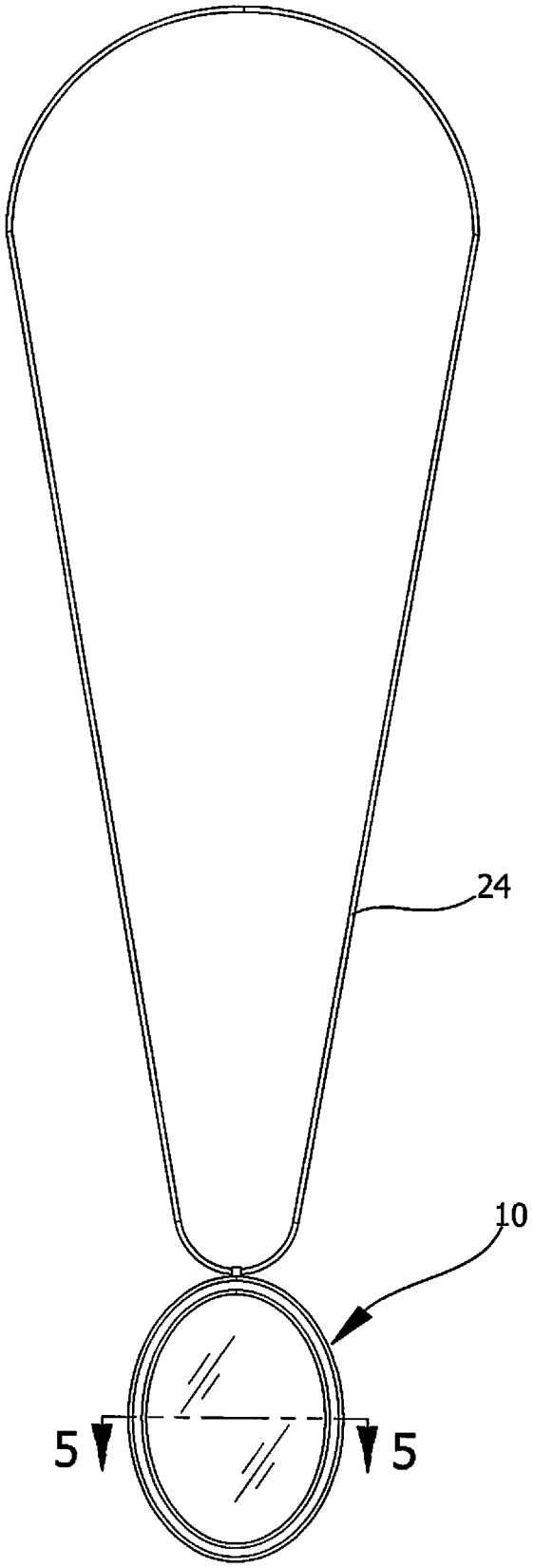
FIG. 4 is a front view of an embodiment of the disclosure.
Figure 5:
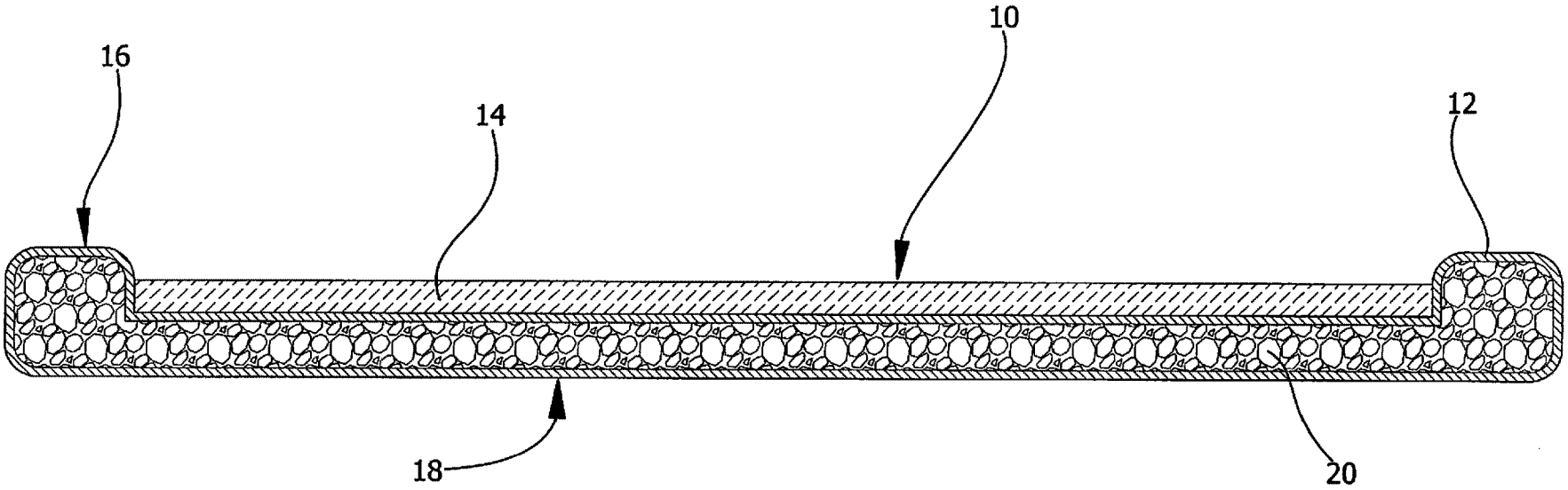
FIG. 5 is a cross-sectional view of an embodiment of the disclosure.
Figure 6:
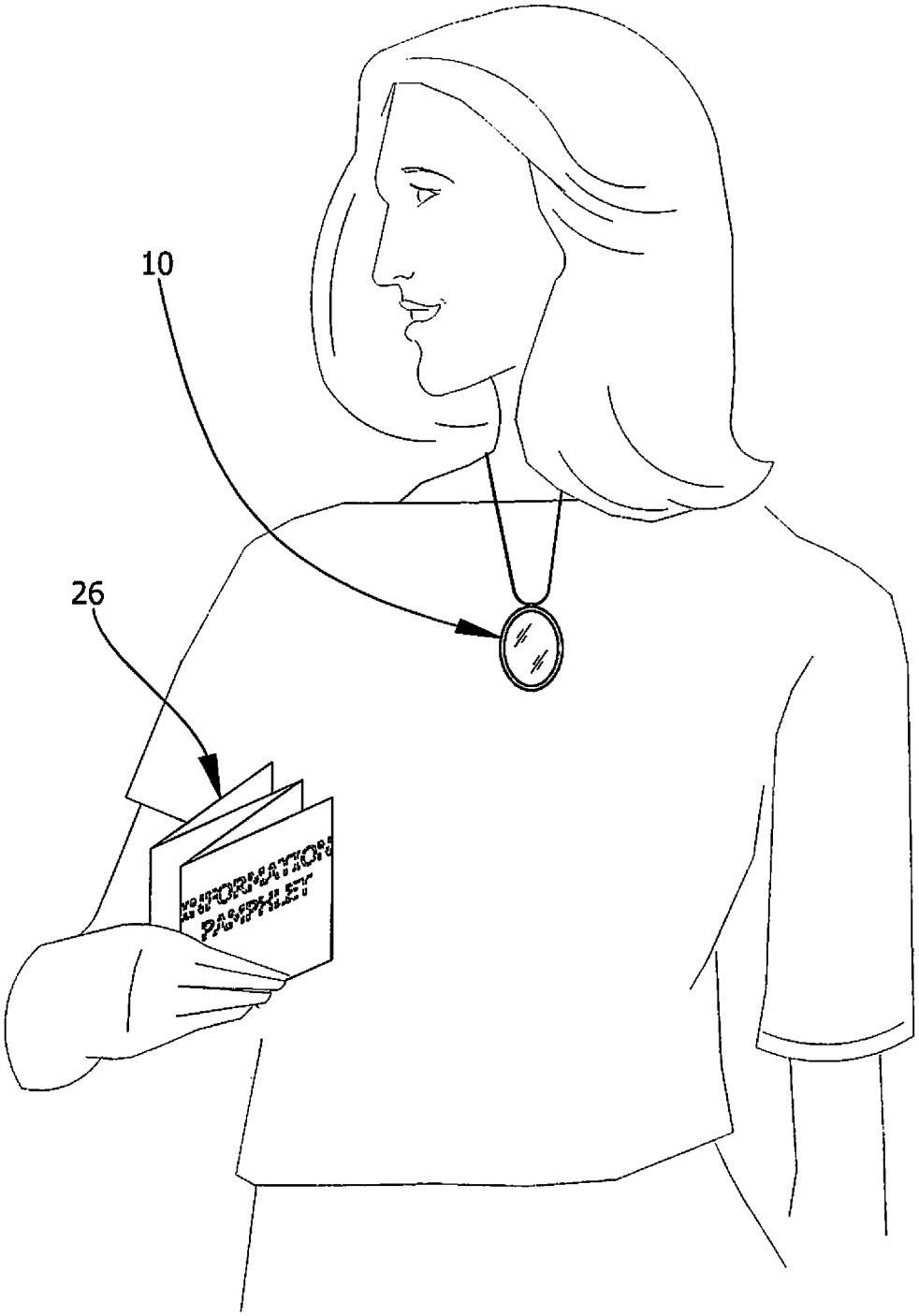
FIG. 6 is a front view of an embodiment of the disclosure in use.

With reference now to the drawings, and in particular to FIGS. 1 through 6 thereof, a new thermochromic necklace pendant embodying the principles and concepts of an embodiment of the disclosure and generally designated by the reference numeral 10 will be described.

As best illustrated in FIGS. 1 through 6, the thermochromic necklace pendant 10 generally comprises A thermochromic necklace pendant 10 includes a pendant frame 12, a mirror 14, and thermochromic material 20. The pendant frame 12 includes a transparent or translucent material. The pendant frame 12 includes an outer border portion 16 and a central mounting portion 18. The mirror 14 is mounted on the central mounting portion 18 and within the outer border portion 16. The outer border portion 16 is hollow. The thermochromic material 20 is positioned in the outer border portion 16 and designed to change colors in response to temperature to create a multi-colored aesthetic effect to boost or improve the mental and emotional health and wellbeing of the wearer and others viewing the necklace pendant 10. In accordance with at least one possible embodiment, the thermochromic material 20 is thermochromic liquid crystals.

In accordance with at least one possible embodiment, the central mounting portion 18 is hollow and additional thermochromic material 20 is positioned in the central mounting portion 18 to permit a user to either display the mirror 14 or flip the necklace pendant 10 around and display the back of the central mounting portion 18 to create a larger multi-colored aesthetic effect.

In accordance with at least one possible embodiment, the thermochromic material 20 is designed to produce a combination of any two or more colors including red, orange, yellow, green, and blue in response to temperature changes.

In accordance with at least one possible embodiment, the thermochromic necklace pendant 10 further includes an attachment structure 22 to connect to a necklace chain or loop 24.

In accordance with at least one possible embodiment, the pendant frame 12 and the mirror 14 are circular or oval-shaped.

In accordance with at least one possible embodiment, the thermochromic necklace pendant 10 is in combination with a multi-language instructional pamphlet 26 providing information regarding meanings of the colors. The information informs a reader, among other things, that blue represents boldness and enthusiasm, green represents prosperousness and wealth, yellow represents kindness and smartness, orange represents joy and peace and intelligence, and red represents patience and love and motivation. Such a pamphlet 26 would increase the enjoyment of the necklace pendant 10 for both the wearer and persons looking at the necklace pendant 10 and its multiple and changing colors.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A thermochromic necklace pendant comprising:

a pendant frame comprising a transparent or translucent material;

said pendant frame comprising an outer border portion and a central mounting portion, said pendant frame having a back, said back being planar, said pendant frame defining a hollow interior within said outer border portion and said central mounting portion, said central mounting portion having a planar front face within said outer border portion, said planar front face and an inner surface of said outer border portion defining a well in said pendant frame, said hollow interior extending around said well within said outer border portion;

a mirror being mounted on said central mounting portion within said well and being surrounded by said outer border portion, the mirror having a thickness such that a forward face of the mirror is inset into the well and the hollow interior within the outer border portion extends forwardly relative to the forward face of the mirror;

and thermochromic material being disposed in said hollow interior within said outer border portion and said central mounting portion, said thermochromic material being configured to change colors in response to temperature.

2. The thermochromic necklace pendant of claim 1, wherein said thermochromic material comprises thermochromic liquid crystals.

3. The thermochromic necklace pendant of claim 2, wherein said thermochromic material is configured to produce a combination of any two or more colors comprising red, orange, yellow, green, and blue in response to temperature changes.

4. The thermochromic necklace pendant of claim 3, further comprising an attachment structure to connect to a necklace chain or loop.

5. The thermochromic necklace pendant of claim 4, wherein said pendant frame and said mirror are circular or oval-shaped.

6. The thermochromic necklace pendant of claim 5, in combination with a multi-language instructional pamphlet providing information regarding meanings of said colors, wherein said information informs a reader that blue represents boldness and enthusiasm, green represents prosperousness and wealth, yellow represents kindness and smartness, orange represents joy and peace and intelligence, and red represents patience and love and motivation.

7. The thermochromic necklace pendant of claim 1, wherein said thermochromic material is configured to produce a combination of any two or more colors comprising red, orange, yellow, green, and blue in response to temperature changes.

8. The thermochromic necklace pendant of claim 1, further comprising an attachment structure to connect to a necklace chain or loop.

9. The thermochromic necklace pendant of claim 1, wherein said pendant frame and said mirror are circular or oval-shaped.

10. The thermochromic necklace pendant of claim 1, in combination with a multi-language instructional pamphlet providing information regarding meanings of said colors, wherein said information informs a reader that blue represents boldness and enthusiasm, green represents prosperousness and wealth, yellow represents kindness and smartness, orange represents joy and peace and intelligence, and red represents patience and love and motivation.

* * * * *